US006808419B1

(12) United States Patent
Korsunsky et al.

(10) Patent No.: US 6,808,419 B1
(45) Date of Patent: Oct. 26, 2004

(54) ELECTRICAL CONNECTOR HAVING ENHANCED ELECTRICAL PERFORMANCE

(75) Inventors: Iosif R. Korsunsky, Harrisburg, PA (US); Chong H. Yi, Mechanicsburg, PA (US); Tod M. Harlan, Mechanicsburg, PA (US); Eric D. Juntwait, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/651,932

(22) Filed: Aug. 29, 2003

(51) Int. Cl.[7] ..... H01R 13/648
(52) U.S. Cl. ..... 439/607
(58) Field of Search ..... 439/607, 608, 439/76.1, 680, 701, 79, 65, 67, 650–654

(56) References Cited

U.S. PATENT DOCUMENTS 5,433,617 A 7/1995 Morlion et al.
5,980,321 A 11/1999 Cohen et al.
6,238,245 B1 * 5/2001 Stokoe et al. ..... 439/608
6,267,604 B1 * 7/2001 Mickievicz et al. ..... 439/79
6,375,508 B1 * 4/2002 Pickles et al. ..... 439/608
6,379,188 B1 * 4/2002 Cohen et al. ..... 439/608
6,390,857 B1 * 5/2002 Pickles et al. ..... 439/680
6,409,543 B1 * 6/2002 Astbury et al. ..... 439/608
6,461,202 B2 * 10/2002 Kline ..... 439/701
6,475,023 B2 * 11/2002 Carneling ..... 439/488
6,500,029 B2 * 12/2002 Nitta ..... 439/608
6,506,076 B2 * 1/2003 Cohen et al. ..... 439/608
6,520,803 B1 * 2/2003 Dunn ..... 439/608
6,537,087 B2 * 3/2003 McNamara et al. ..... 439/108
6,540,522 B2 * 4/2003 Sipe ..... 439/61
6,579,124 B1 * 6/2003 Vanbesien ..... 439/608
6,602,095 B2 * 8/2003 Astbury et al. ..... 439/608
6,607,402 B2 * 8/2003 Cohen et al. ..... 439/608
6,612,869 B1 * 9/2003 Billman ..... 439/608
6,623,302 B2 * 9/2003 Billman et al. ..... 439/608
6,623,310 B1 * 9/2003 Billman et al. ..... 439/701
6,634,908 B1 * 10/2003 Billman et al. ..... 439/608
6,638,079 B1 * 10/2003 Billman et al. ..... 439/76.1
6,638,110 B1 * 10/2003 Billman ..... 439/608
6,641,438 B1 * 11/2003 Billman ..... 439/608
6,648,689 B1 * 11/2003 Billman et al. ..... 439/608
6,652,319 B1 * 11/2003 Billman ..... 439/608
6,655,966 B2 * 12/2003 Rothermel et al. ..... 439/76.1
6,659,808 B2 * 12/2003 Billman et al. ..... 439/680
6,663,401 B2 * 12/2003 Billman et al. ..... 439/76.1
6,663,426 B2 * 12/2003 Fedder et al. ..... 439/608
6,663,427 B1 * 12/2003 Billman et al. ..... 439/608
6,663,429 B1 * 12/2003 Korsunsky et al. ..... 439/608
6,666,692 B2 * 12/2003 Billman et al. ..... 439/76.1
6,672,886 B2 * 1/2004 Billman ..... 439/82
6,682,369 B1 * 1/2004 Korsunsky et al. ..... 439/608
6,685,488 B2 * 2/2004 Billman et al. ..... 439/108
6,692,305 B2 * 2/2004 Nelson et al. ..... 439/608

* cited by examiner

*Primary Examiner*—Ross Gushi
(74) *Attorney, Agent, or Firm*—Wei Te Chung

(57) ABSTRACT

An electrical connector (1) includes a dielectric housing (2) defining a number of parallel slots (23), a number of terminals (5, 5', 7) arranged in rows in the housing, and a number of parallelly arranged circuit boards (3) received in corresponding slots of the housing. The terminals have contacting beams (52, 52', 72) electrically connecting with the circuit boards, and tail portions (54, 54', 74) for electrical connection to a printed circuit board on which the connector is mounted. A shield member (4, 4') substantially encloses the housing and the circuit boards. The shield member includes a number of inwardly extruded lances (45) located between adjacent circuit boards and electrically contacting with the circuit boards.

20 Claims, 18 Drawing Sheets

ELECTRICAL CONNECTOR HAVING ENHANCED ELECTRICAL PERFORMANCE

CROSS-REFERENCE TO RELATED APPLICATIONS

Relevant subject matter is disclosed in U.S. patent application Ser. No. 10/165,561 filed on Jun. 7, 2002 and entitled "HIGH SPEED, HIGH DENSITY BACKPLANE CONNECTOR".

BACKGROUND OF THE INVENTION

1. Field of the Invention

The present invention relates to an electrical connector, and particularly to a high density electrical connector having a plurality of circuit boards for high speed signal transmission.

2. Description of Related Art

Electrical connectors are used in many electronic systems. As miniaturization of the electronic systems becomes more prevalent, the dimensions of the connector itself decrease but the number of signal circuits routed through the connector increases. This results in an increasing number of signals in the limited space of the connector. As the signal circuits are spaced closer and the transmission speed of the signals increases, electromagnetic inference (EMI) and the crosstalk become a serious problem.

Accordingly, electrical connectors are equipped with shielding to attempt to shield each signal from EMI from neighboring signals. This shielding can be a conventional mechanical shield or an electrical shield in the form of a ground line. U.S. Pat. Nos. 5,066,236 and 5,104,341 each disclose a receptacle connector having shielding members. Cross-talk shield members are insertable into the rear of the connector housing to shield adjacent vertical rows of terminals from crosstalk, while upper and lower shield members are insertable over the assembly to shield the assembly from EMI. The upper and the lower shielding members provide resilient fingers for contacting with grounding contacts of a mating header to thereby establish a grounding circuitry therebetween. However, the arrangement of positioning the cross-talk shield members between the adjacent rows of the terminals reduces the effective signal density. Significantly, the employment of the upper and the lower shield members complicates the manufacture of the connector as well as the assembly thereof.

U.S. Pat. No. 5,433,617, issued to Morlion et al., discloses an electrical connector assembly. The connector assembly comprises a header connector and a receptacle connector mounted on respective printed circuit boards, wherein the header connector provides first shielding plates while the receptacle connector provides side-by-side positioned, ground contact plates and a second shielding plate. Electrical connections and mechanical supports are established between corresponding parts of the first shielding plates, the second shielding plate and the ground contact plates. Specially, in the coupled position of the assembly, the first shielding plates of the header provide contact springs simultaneously engaging the edges of the ground contact plates and the second shielding plate of the receptacle. Further, the first shield plates, the ground contact plates and the second shield plate have contact elements contacting corresponding conductors of the printed circuit boards on which the header and the receptacle are respectively mounted. Thus, the grounding circuits of the assembly are established. Moreover, in an alternative embodiment of the patent, a third shield plate is even provided. Obviously, the connector assembly as described above is unsuitable for mass-produce due to complicated manufacturing process and assembling process, both of which increase the cost.

U.S. Pat. No. 6,520,803, issued to Dunn, discloses a receptacle connector. At least one shielding plates are arranged between adjacent two rows of contact elements. A shielding member is attached on assembled connector housing members. The shielding member includes a plurality of cantilevered deflectable hooks received in corresponding recesses formed in the slender edges of the shielding plates to achieve a shielding purpose. It should be noted that in order to ensure a reliable connection between the shielding plates and the shielding member, the hooks and the recesses must be shaped to have the special configuration as disclosed in the patent, which results in the difficulty of manufacturing the connector.

U.S. Pat. No. 5,980,321, issued to Cohen et al., discloses a receptacle connector comprising a plurality of wafers side-by-side stacked and a metal stiffer holding the wafers in a required position. Each wafer is made in two pieces, a shield piece and a signal piece. The shield piece is formed by insert molding housing around a front portion thereof. The signal piece is made by insert molding housing around contacts. Further, in order to hold each wafer in the required position without rotation, three connection points are established between the metal stiffer and the wafer. The connection comprises projections formed on the wafer and corresponding slots defined in the stiffer. It should be noted that the projections must be accurately aligned with corresponding slots, respectively, thereby complicating the manufacture of the connector as well as the assembly thereof.

Hence, an improved electrical connector is required to overcome the disadvantages of the related art.

SUMMARY OF THE INVENTION

Accordingly, a first object of the present invention is to provide a high density electrical connector having enhanced electrical performance with a simplified configuration.

A second object of the present invention is to provide a high density electrical connector that can be easily manufactured and assembled.

In order to achieve the objects set forth, a high density electrical connector in accordance with the present invention comprises a dielectric housing defining a plurality of parallel slots, a plurality of terminals arranged in rows in the slots, and a plurality of parallelly arranged circuit boards received in corresponding slots of the housing. The terminals have contacting beams electrically connecting with conductive traces of the circuit boards, and tail portions for electrical connection to a printed circuit board on which the connector is mounted. A shield member substantially encloses the housing and the circuit boards. The circuit boards are retained by and between the housing and the shield member.

According to one aspect of the present invention, the shield member comprises a plurality of inwardly extruded lances not only separating adjacent circuit boards for mechanical consideration but also electrically contacting with the circuit boards for electrical consideration.

According to another aspect of the present invention, the circuit board has a mounting portion with the terminals connected thereto, and a mating portion with differential pairs of signal pads on one side thereof and grounding pads on two opposite sides thereof. Plural grounding traces electrically connect with the grounding pads and plural differential pairs of signal traces electrically connect with corresponding signal pads. The signal traces are arranged on the same side with the signal pads. The signal traces of the differential pair extend from corresponding signal pads adjacent innermost edges thereof to the mounting portion.

According to still another aspect of the present invention, each row of the terminals comprises plural differential pairs of signal terminals and plural pairs of grounding terminals. The pairs of the signal and the grounding terminals are alternatingly arranged. Each terminal further comprises an intermediate portion interconnecting the contacting beam with the tail portion. The contacting beams of the differential pair of the signal terminals extend upwardly from the intermediate portions adjacent innermost edges thereof.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
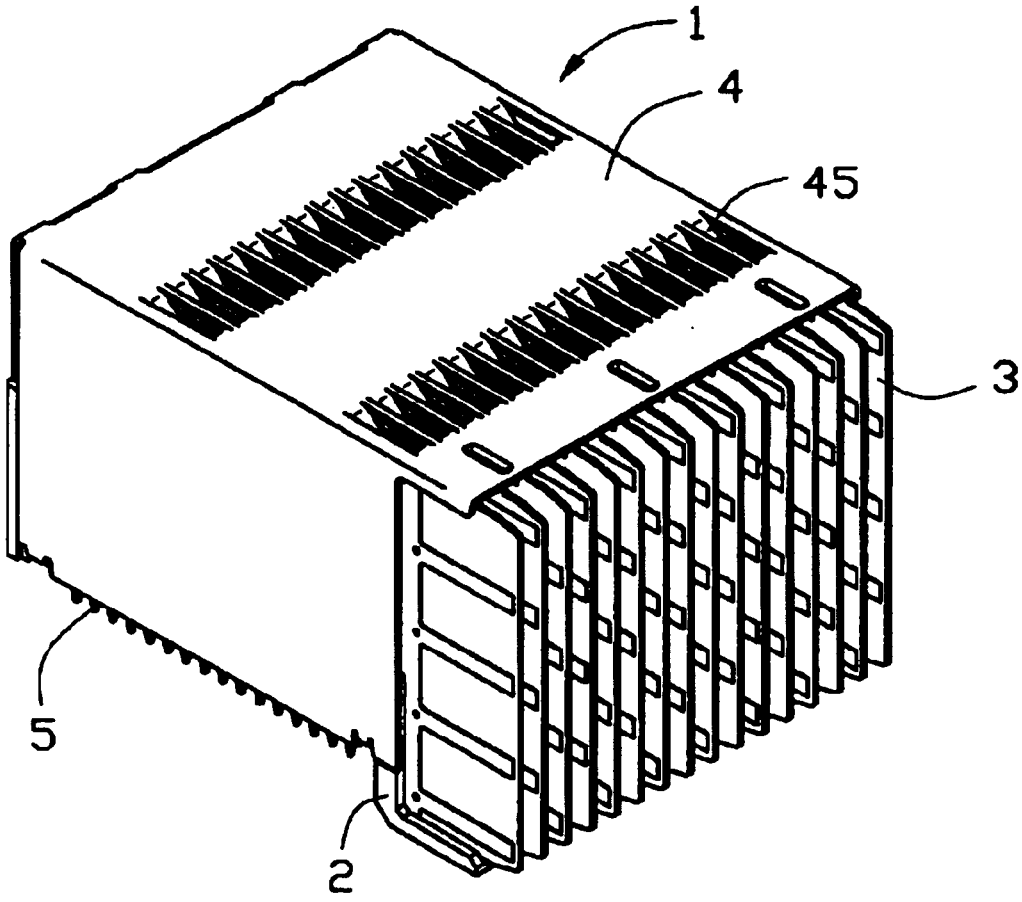
FIG. 1 is a top perspective view of an electrical connector in accordance with the present invention.
Figure 2:
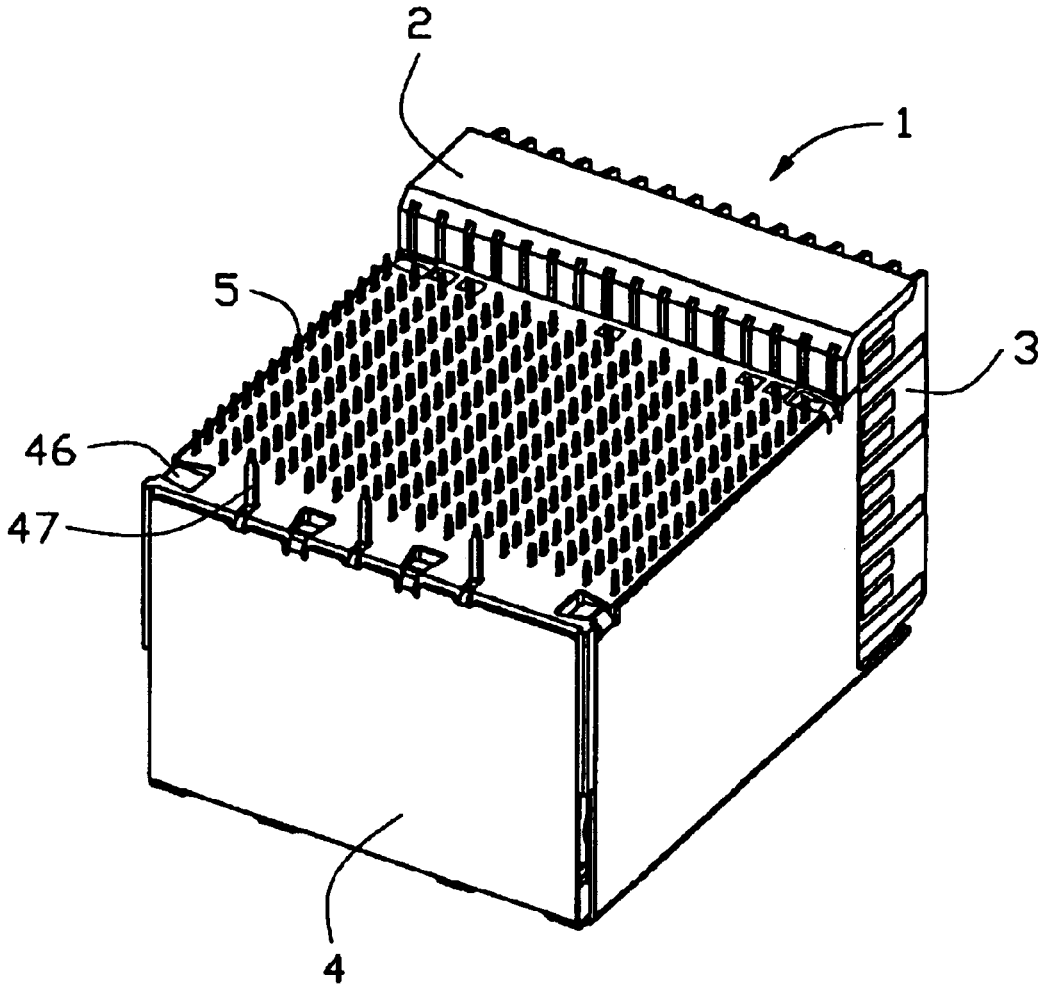
FIG. 2 is a bottom perspective view of the electrical connector shown in FIG. 1.

FIGS. 1 and 2 show an electrical connector 1 in accordance with the present invention for mounting to a printed circuit board (not shown). The connector 1 comprises a dielectric housing 2, a plurality of circuit boards 3 received in the housing 2, and a shield member 4 substantially enclosing the housing 2 and the circuit boards 3 for electromagnetic interference (EMI) protection.

Figure 3:
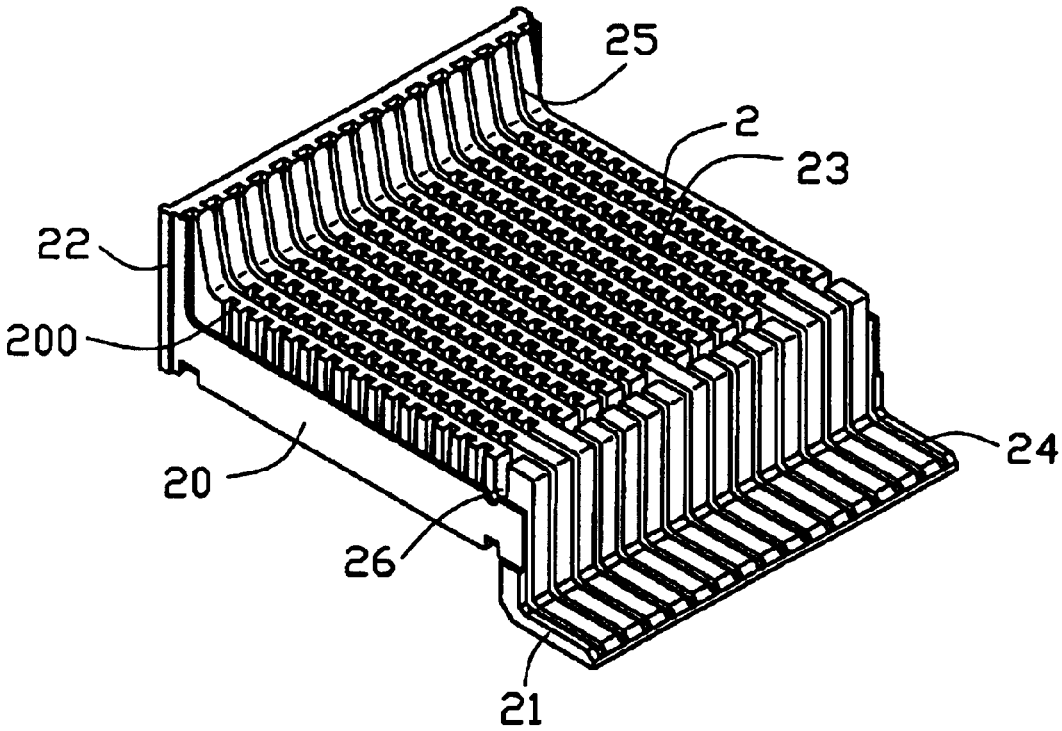
FIG. 3 is a top perspective view of a dielectric housing of the connector shown in FIG. 1.
Figure 4:
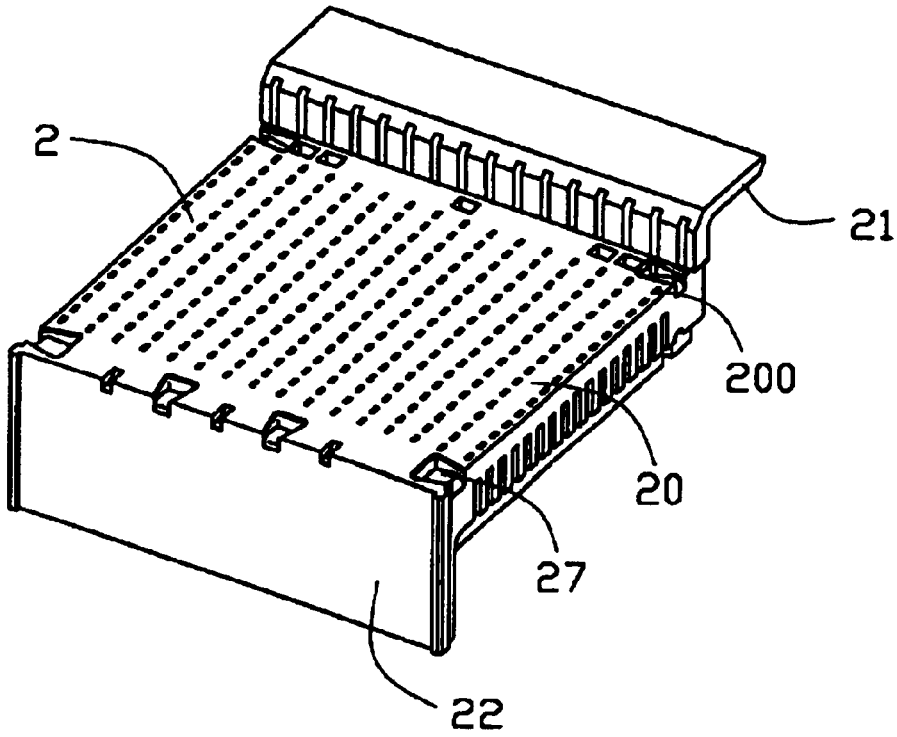
FIG. 4 is a bottom perspective view of the dielectric housing.

With reference to FIGS. 3–4, the housing 2 includes a rectangular body 20, a front tongue 21 extending forwardly from a lower portion of one end of the body 20 and a rear support 22 projecting upwardly from an opposite end of the body 20. The body 20 defines a plurality of parallel slots 23 extending along a longitudinal direction of the housing 2, and a plurality of rows of passageways 200 communicating with the slots 23 and penetrating through a bottom thereof. The tongue 21 defines a plurality of grooves 24 aligned with corresponding slots 23. The rear support 22 defines a plurality of channels 25 also aligned with corresponding slots 23. The housing 2 defines a bore 26 extending therethrough. The housing 2 defines a plurality of recesses 27 in the bottom thereof.

Figure 8:
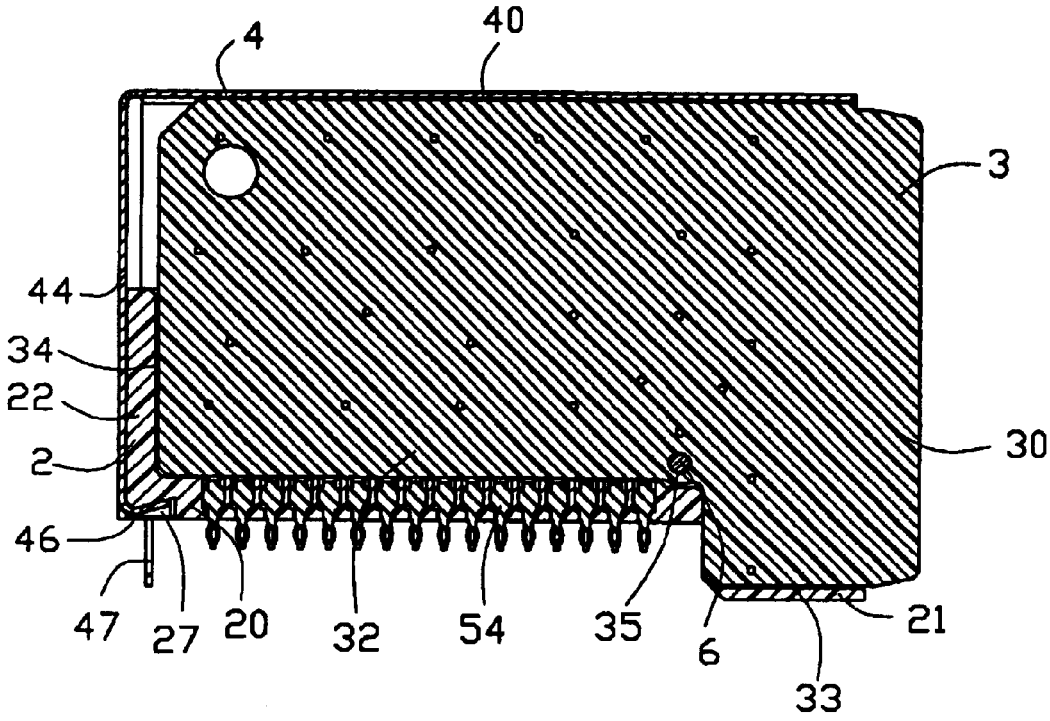
FIGS. 8–10 are cross-section views of the connector of FIG. 1, taken from different sections.
Figure 9:
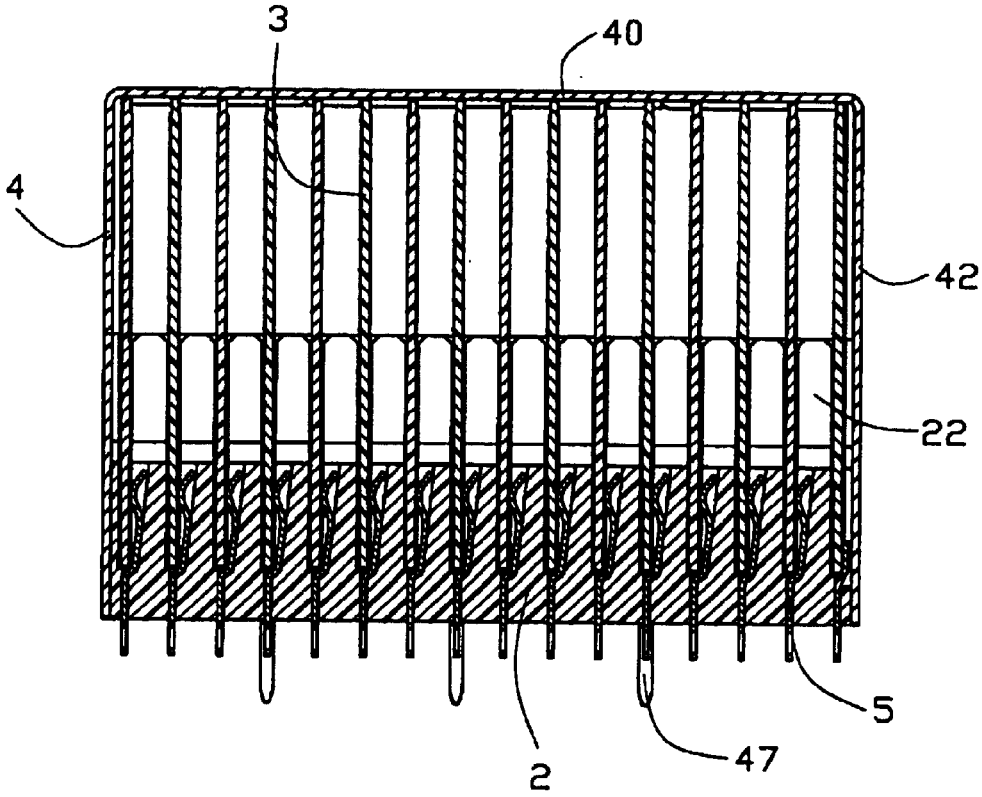
Figure 10:
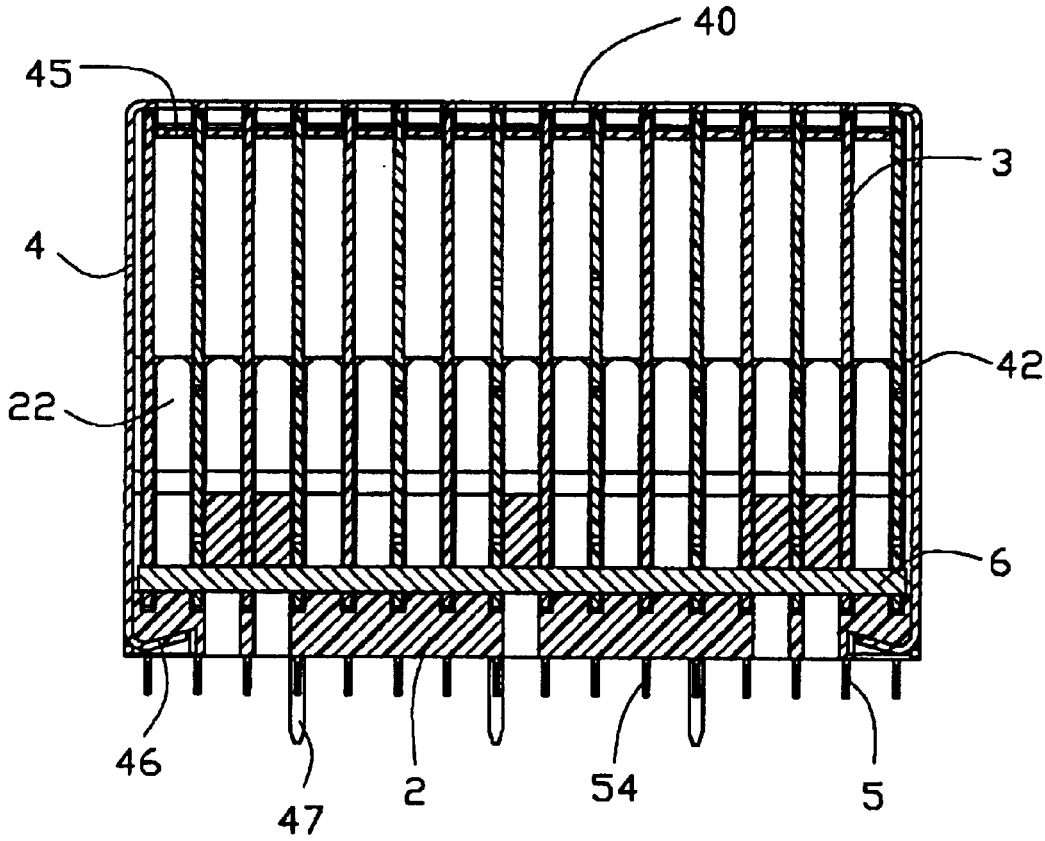

Referring to FIGS. 8–10 in conjunction with FIGS. 1 and 2, each of the circuit boards 3 has a mating portion 30 and a mounting portion 32. Each of the circuit boards 3 includes a dielectric substrate made of conventional circuit board substrate material, such as FR4, and signal and grounding traces on the substrate. The signal and the grounding traces of the circuit board 3 provide electrical paths from the mating portion 30 to the mounting portion 32. The circuit boards 3 are installed into the housing 2 by inserting the mounting portions 32 into the slots 23. Simultaneously, the circuit boards 3 have front, lower edges 33 received in the grooves 24 and rear edges received in the channels 25. Each of the circuit boards 3 defines a through hole 35 aligned with the bore 26 of the housing 2. After the circuit boards 3 are assembled to the housing 2, an alignment pin 6 is provided to insert through the bore 26 of the housing 2 and the through holes 35 of the circuit boards 3, thereby ensuring an accurate position of the mating portions 30. In a preferred embodiment of the present invention, the through holes 35 are plated with conductive material to electrically connect to the grounding traces, and the alignment pin 6 is made from conductive material to thereby establish an electrical connection between the alignment pin 6 and the circuit boards 3 via the through holes 35.

Figure 11:
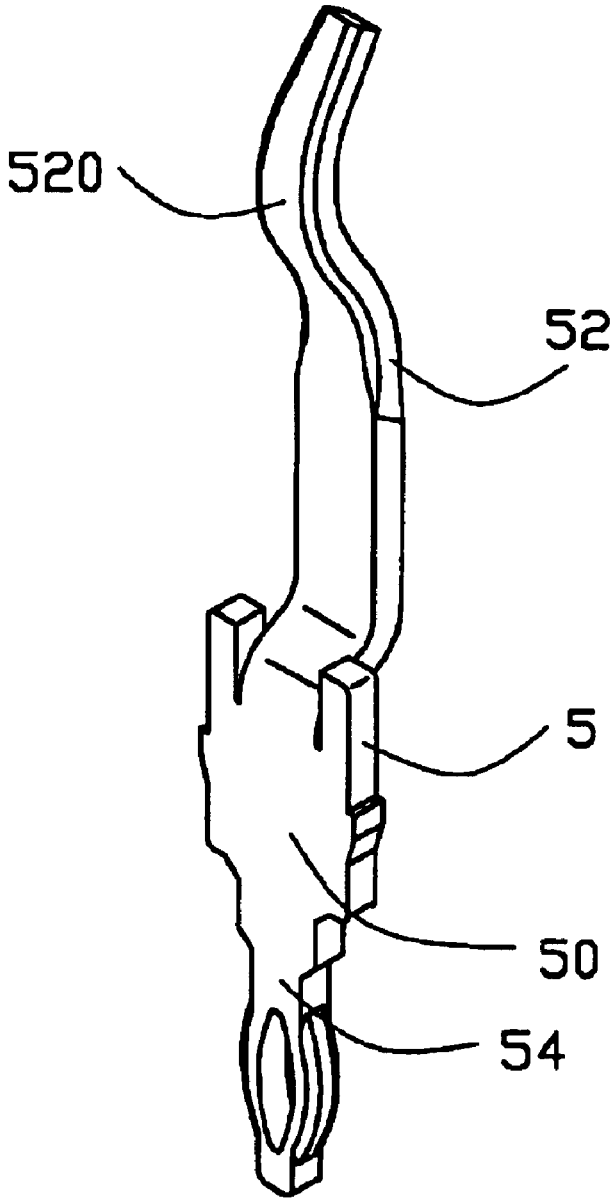
FIG. 11 is an enlarged perspective view of a first type of contact that may be used in the connector.

The connector 1 provides a plurality of terminals 5 received in the passageways 200 of the housing 2 for mounting the connector 1 onto the printed circuit board. Referring to FIG. 9, in an optional embodiment of the present invention, the terminals 5 are resiliently contacting with the circuit boards 3. The terminals 5 are arranged in rows in the passageways 200 of the housing 2. The rows of the terminals 5 and the circuit boards 3 are alternatingly arranged. As shown in FIG. 11, each terminal 5 includes an intermediate portion 50 having an interference fit in a corresponding passageway 200, a mating portion 52 extending upwardly from the intermediate portion 50, and a press-fit tail 54 extending downwardly from the intermediate portion 50. The mating portion 52 has a curved contact section 520 projecting into a corresponding slot 23 to contact with a corresponding circuit board 3. The press-fit tail 54 extends downwardly beyond the bottom of the housing 2 for being press-fitted into through holes of the printed circuit board. Thus, an electrical connection is established between the circuit boards 3 and the printed circuit board on which the connector 1 is mounted via the terminals 5.

Figure 16:
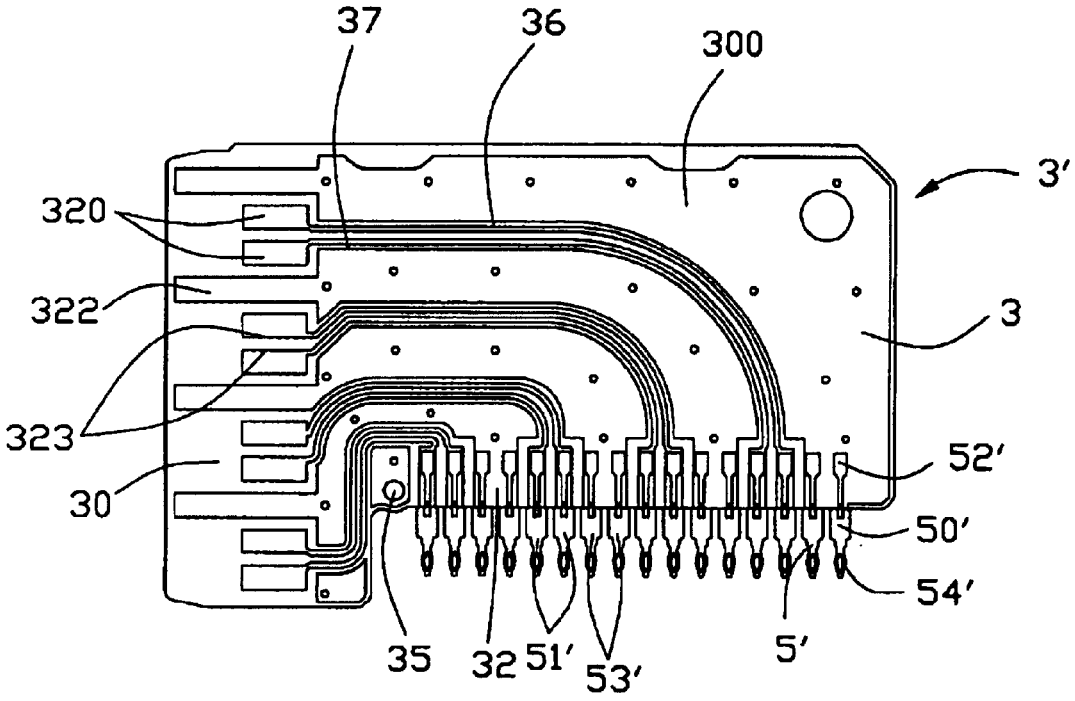
FIG. 16 is a first side elevation view of a wafer including a circuit board and contacts of second type secured to the circuit board according to an alternative embodiment of the present invention.

It should be noted that the terminals may be secured to the mounting portion 32 of the circuit board 3 by soldering to form a circuit board wafer as shown in FIG. 16, which will be described in detail hereinafter.

Figure 5:
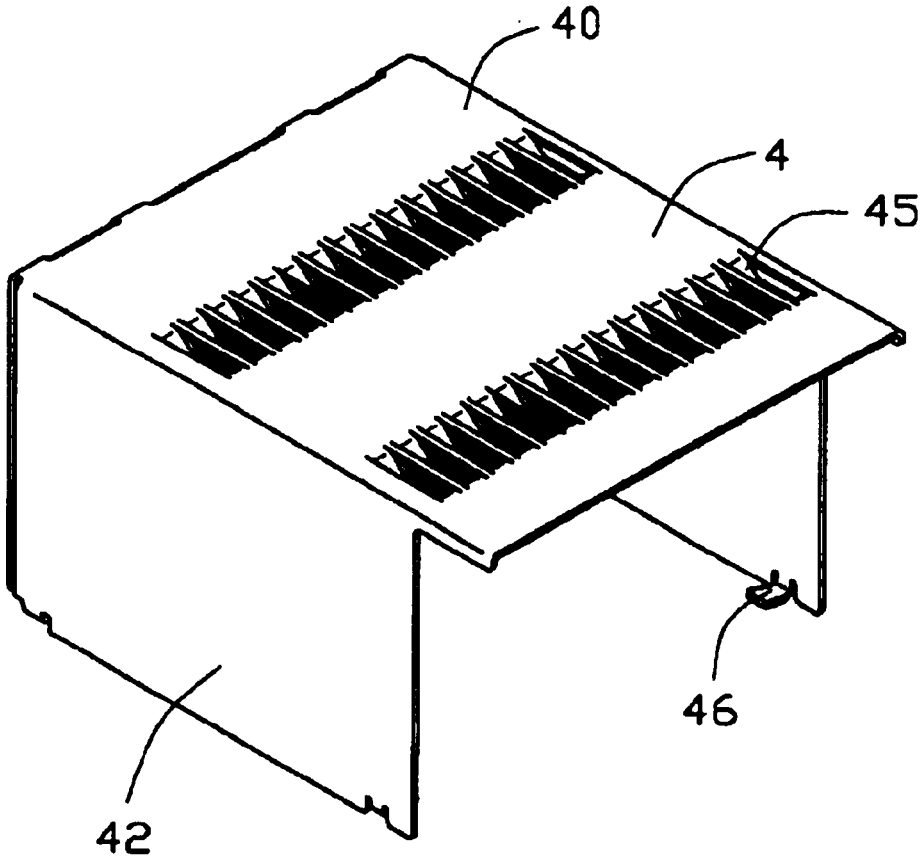
FIG. 5 is a top perspective view of a shield member of the connector shown in FIG. 1.
Figure 6:
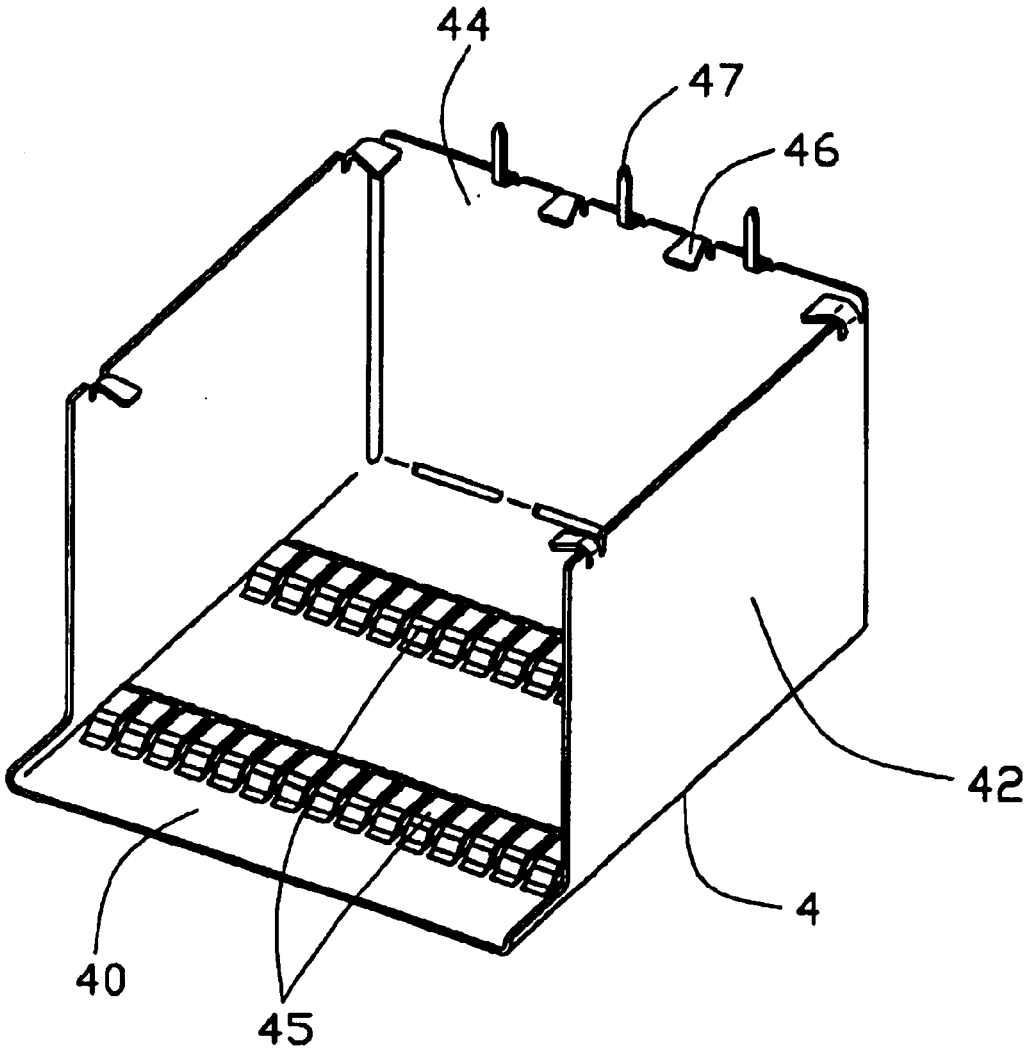
FIG. 6 is a bottom perspective view of the shield member shown in FIG. 5.

Referring to FIGS. 5–6, the shield member 4 is stamped from a metal sheet and configured as a substantially rectangular box. The shield member 4 is attached to the housing 2 and substantially encloses the circuit boards 3 and the housing 2. The shield member 4 has a top plate 40 covering a top of the circuit boards 3, a pair of side plates 42 extending downwardly from opposite side edges of the top plate 40 to cover opposite outermost circuit boards 3, and a rear plate 44 extending downwardly from a rear edge of the top plate 40 to cover rear edges of the circuit boards 3 and the support 22 of the housing 2. As shown in FIG. 10, the side plates 42 of the shield member 4 electrically contact with opposite ends of the metal pin 6, whereby an electrical connection is established between the shield member 4 and the circuit boards 3 for achieving a better grounding effect. The shield member 4 includes a plurality of inwardly extruded lances 45 stamped from the top plate 40 thereof. The lances 45 are arranged in two rows and located between adjacent circuit boards 3 to separate and position the circuit boards 3. It should be noted that the lances 45 could also contact with the grounding traces of the circuit boards 3 to enhance EMI electrical performance. The shield member 4 is formed with a plurality of fastening tabs 46 to be retained in the recesses 27 of the housing 2 for interlocking the shield member 4 with the housing 2. A plurality of grounding fingers 47 extends downwardly from the rear plate 44 for electrically connecting to the printed circuit board.

Figure 7:
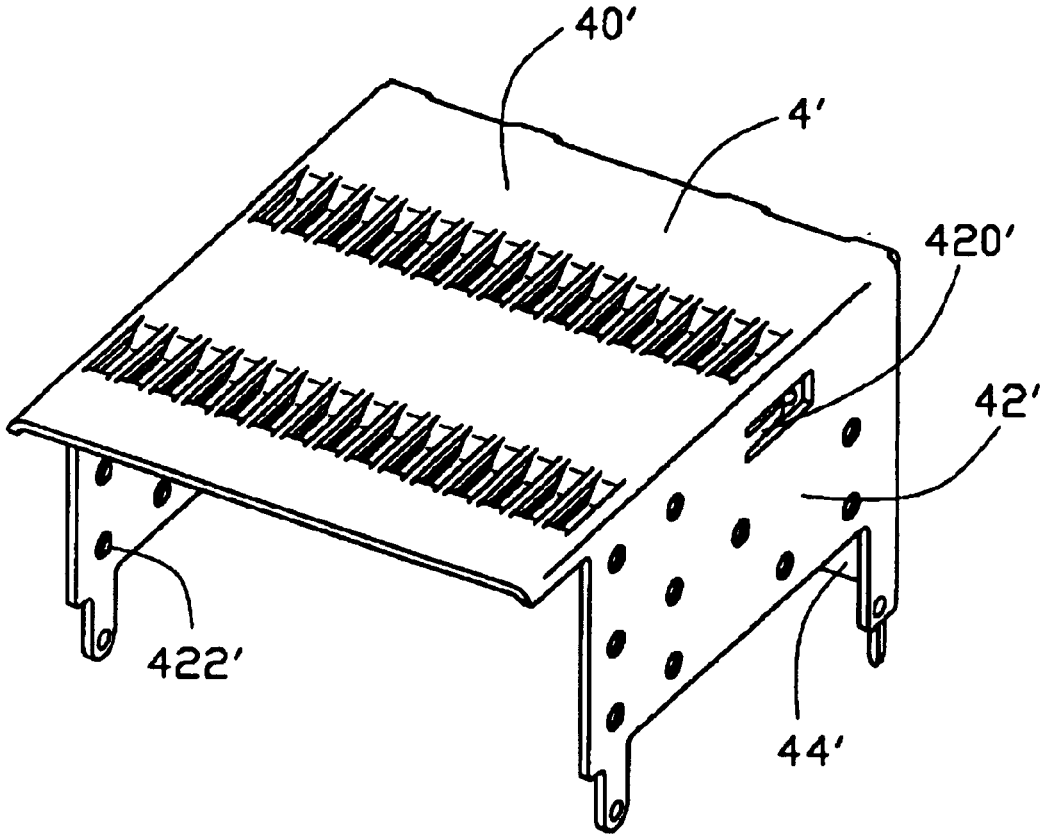
FIG. 7 is a perspective view of a shield member according to an alternative embodiment of the present invention.

FIG. 7 shows a shield member 4' according to an alternative embodiment of the present invention. The shield member 4' is stamped from a metal sheet and is configured as a rectangular box, which is similar as the shield member 4. The shield member 4' has a top plate 40', a pair of side plates 42' and a rear plate 44'. The side plates 42' is formed with a pair of spring tangs 420' and a plurality of inward embossments 420' for contacting with the grounding traces of opposite outermost circuit boards 3 so that a better EMI protection can be achieved.

Figure 12:
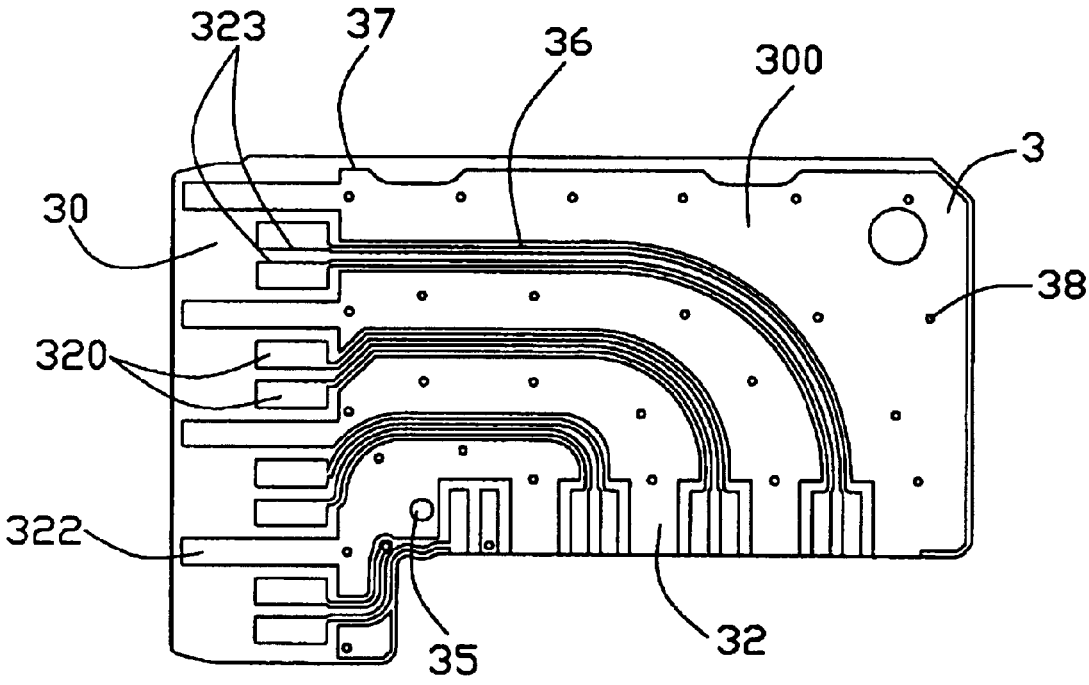
FIG. 12 is a first side elevation view of a first type of circuit board that may be used in the connector.
Figure 13:
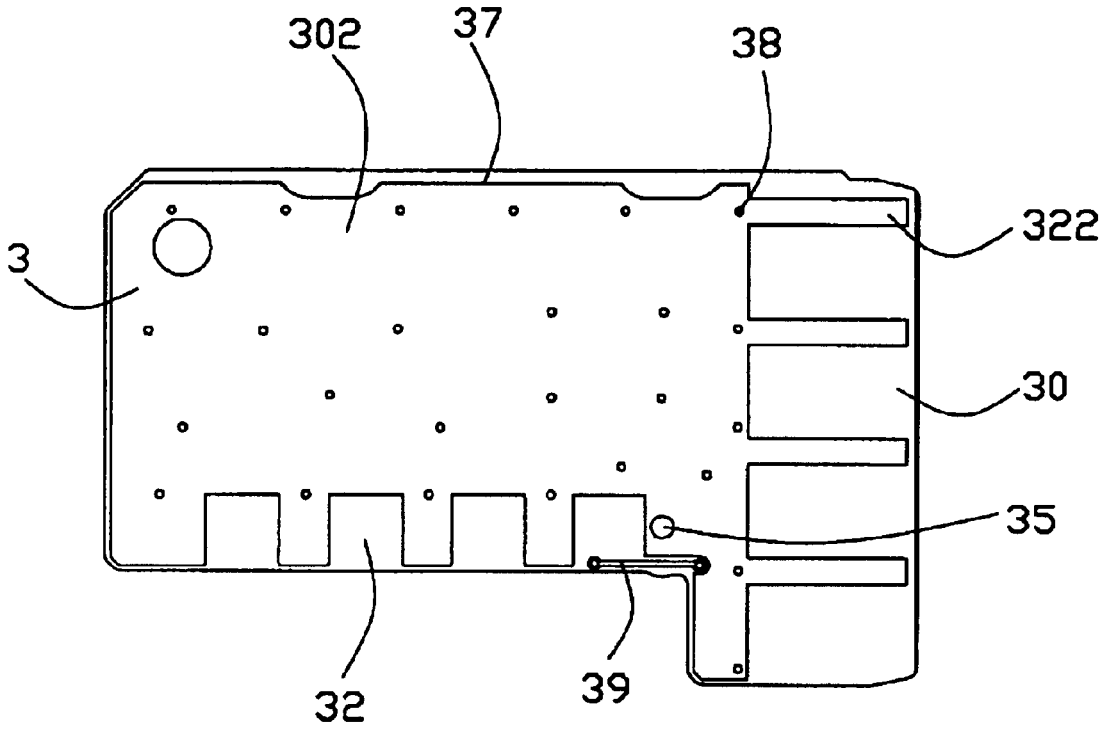
FIG. 13 is a second side elevation view of the first type of circuit board.
Figure 14:
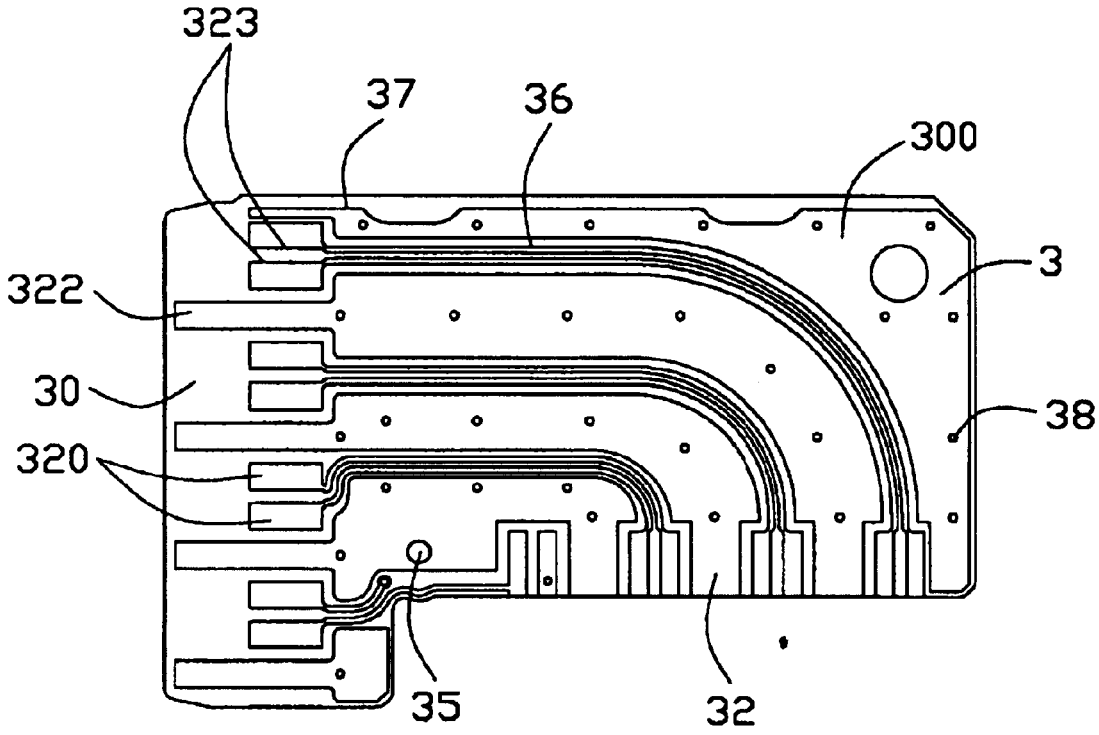
FIG. 14 is a first side elevation view of a second type of circuit board that may be used in the connector.
Figure 15:
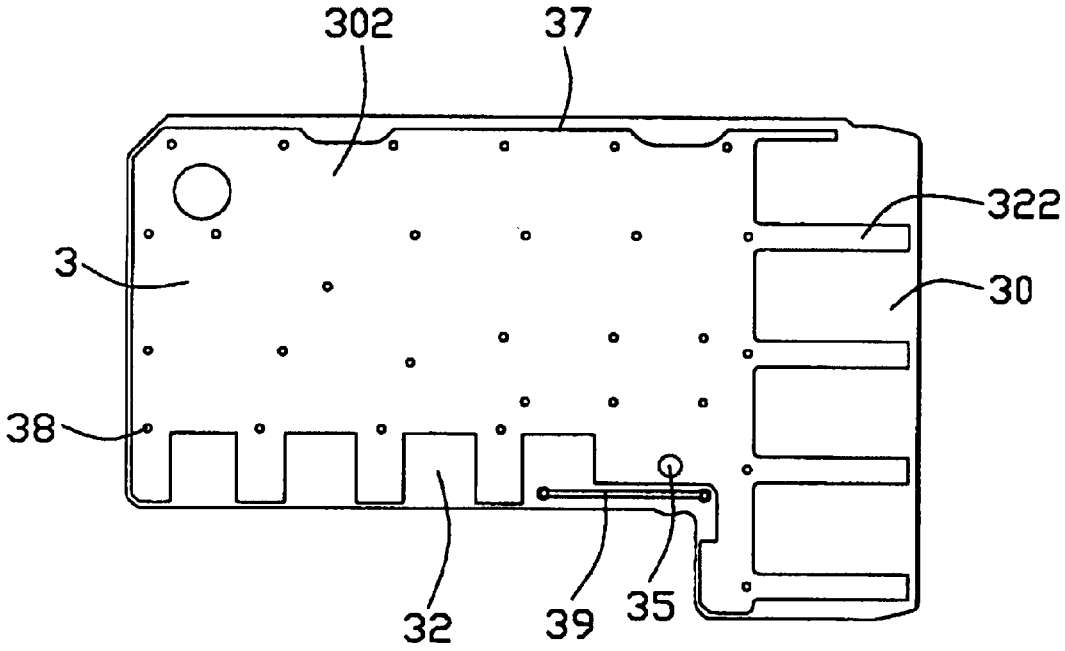
FIG. 15 is a second side elevation view of the second type of circuit board.

With reference to FIGS. 12–15, two types of circuit boards 3 are shown in exemplary embodiments. FIGS. 12 and 13 show opposite faces of the circuit board 3 of first type, and FIGS. 14 and 15 show opposite faces of the circuit board 3 of second type. The circuit boards 3 of the first type and the second type are alternately arranged in the housing 2, as best shown in FIG. 1. On a first face 300 of each circuit board 3 are alternating signal traces 36 and grounding traces 37, and on a second face 302 of each circuit board 3 are only the grounding traces 37. Different types of the circuit boards 3 are distinguished by different layouts of the signal traces 36 and the grounding traces 37.

Each circuit board 3 has contact pads on the mating portion 30 which are allocated as signal pads 320 and grounding pads 322. The signal pads 320 are electrically connected to the signal traces 36, and these pads 320 are all on the first face 300 of each circuit board 3. The grounding pads 322 are electrically connected to the grounding traces 37, and these pads 322 are disposed on the first face 300 and the second face 302 of each wafer. The grounding pads 322 on the opposite faces are substantially mirror image with each other. Electrical connections between the grounding pads 322 on the opposite faces of the circuit board 3 are made by the grounding traces 37 through conductive vias 38.

According to the invention, the signal traces 36 are coupled to have plural differential pairs on the first face 300. Adjacent differential pairs of the signal traces 36 are separated by the grounding traces 37. The signal traces 36 of the differential pair extend from corresponding signal pads 320 adjacent innermost edges 323, i.e., the signal traces 36 of the differential pair are very closely spaced to have a relatively large distance between adjacent differential pairs, thereby enhancing reduction of crosstalk between adjacent differential pairs. The lowest differential pair has trace 39 on the second face 302 to reduce length and make trace routing easier.

Figure 17:
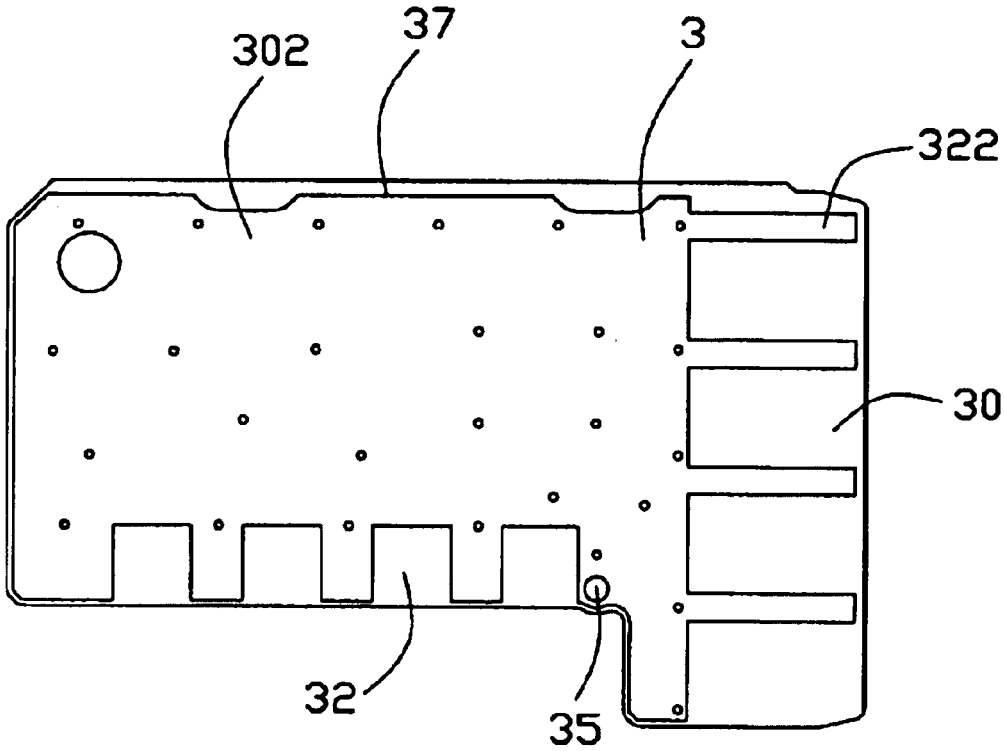
FIG. 17 is a second side elevation view of the circuit board shown in FIG. 16.

FIG. 16 shows a circuit board wafer 3' used in the connector 1 according to an alternative embodiment of the present invention. The wafer 3' includes the circuit board 3 received in a corresponding slot 23 of the housing 2, and a row of terminals 5' secured to the mounting portion 32 of the circuit board 3 by soldering. Each terminal 5' includes an intermediate portion 50' having an interference fit in a corresponding passageway 200 of the housing 2, a contacting beam 52' extending upwardly from the intermediate portion 50' and soldering with the mounting portion 32, and a press-fit tail 54' extending downwardly from the intermediate portion 50' for electrical connection to the printed circuit board. The terminals 5' include signal terminals 51' and grounding terminals 53' respectively connecting with the signal traces 36 and the grounding traces 37. Every adjacent two differential pairs of the signal terminals 51' are separated by two grounding terminals 53'. FIG. 17 shows an opposite side of the circuit board wafer 3' with the terminals 5' being omitted.

Figure 18:
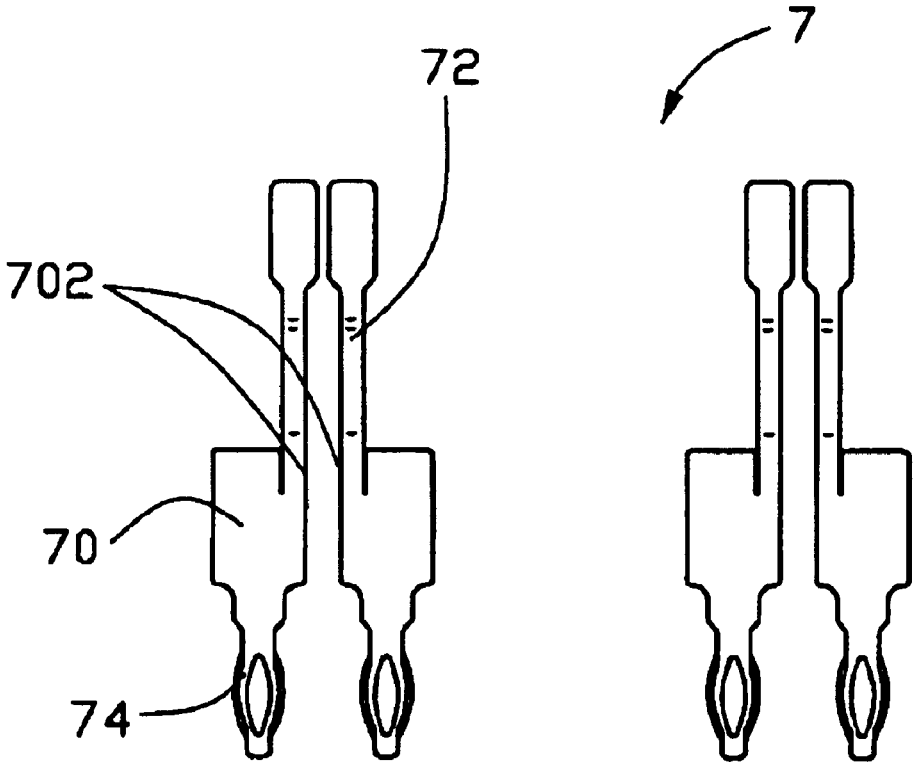
FIG. 18 is an elevation view of adjacent two differential pairs of signal contacts of third type that are similar to the contacts of second type except that two contacting beams of a differential pair are closely spaced.

FIG. 18 shows adjacent two differential pairs of signal terminals 7 for soldering to the mounting portion 32 of the circuit board 3 according to an alternative embodiment of the present invention. The adjacent two differential pairs of the signal terminals 7 are separated by two grounding terminals 53' as shown in FIG. 16 which are omitted here. Each terminal 7 includes an intermediate portion 70, a contacting beam 72 extending upwardly from the intermediate portion 70 for soldering to the mounting portion 32 of the circuit board 3, and a press-fit tail 74 extending downwardly from the intermediate portion 70 for electrical connection to the printed circuit board, which is similar as the terminal 5'. The contacting beams 72 of the differential pair extend upwardly from the intermediate portions 70 adjacent innermost edges 702 to have a larger distance between adjacent differential pairs compared to the signal terminals 52' shown in FIG. 16, thereby further decreasing crosstalk of adjacent differential pairs.

It is noted that the shield member 4, 4' in conjunction with the housing 2 obviate the need for a separate box or housing to hold the circuit boards 3, thereby simplifying the connector 1. It is also noted that the employment of the shield member 4, 4' and the circuit boards 3 or the circuit board wafers 3' as described in the present invention enhances the electrical performance of the connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a printed circuit board, comprising:

a unitary dielectric housing defining a plurality of parallel slots;

a plurality of terminals arranged in rows in the slots;

a plurality of parallelly arranged circuit boards received in corresponding slots of the housing, each circuit board having conductive traces electrically connecting with the terminals; and a shield member substantially enclosing the housing and the circuit boards, the circuit boards being retained by and between the shield member and the housing.

2. The electrical connector as claimed in claim 1, wherein the shield member comprises a plurality of inwardly extruded lances located between adjacent circuit boards.

3. The electrical connector as claimed in claim 2, wherein the conductive traces of each circuit board comprise signal traces on one side thereof and grounding traces on two opposite sides thereof, and the lances are electrically contacted with the grounding traces of the circuit boards to achieve a grounding purpose.

4. The electrical connector as claimed in claim 3, wherein the shield member is configured as a substantially rectangular box and is formed with grounding fingers for electrically connecting to a printed circuit board.

5. The electrical connector as claimed in claim 4, wherein the shield member comprises a top plate covering a top of the parallel arranged circuit boards and a rear plate covering a rear of the housing and the circuit boards, the grounding fingers extending downwardly from the rear plate.

6. The electrical connector as claimed in claim 4, wherein the shield member comprises a top plate with the extruded lances being stamped therefrom and a pair of side plates extending from opposite lateral edges of the top plate.

7. The electrical connector as claimed in claim 6, wherein the side plates comprise a pair of inwardly extending spring tangs electrically contacting with opposite outermost circuit boards.

8. The electrical connector as claimed in claim 1, wherein the housing defines a plurality of recesses in a bottom thereof, and the shield member comprises a plurality of fastening tabs retained in corresponding recesses.

9. The electrical connector as claimed in claim 1, wherein the housing comprises a front tongue at a lower portion of one end thereof, the front tongue defining a plurality of grooves aligned with corresponding slots, and wherein the circuit boards have mating portions with lower edges received in corresponding grooves.

10. The electrical connector as claimed in claim 9, wherein the housing comprises a rear support at an opposite end thereof, the support defining a plurality of channels aligned with corresponding slots, and wherein the circuit boards have rear edges received in corresponding channels.

11. The electrical connector as claimed in claim 1, further comprising an alignment pin, and wherein each of the circuit boards defines a through hole, the alignment pin inserting through the housing and the through holes of the circuit boards.

12. The electrical connector as claimed in claim 11, wherein the through holes of the circuit boards are plated through holes which are electrically connected to corresponding conductive traces on the circuit boards, and the alignment pin is a metal pin electrically contacting with the circuit boards via the plated through holes.

13. The electrical connector as claimed in claim 1, wherein the rows of the terminals and the circuit boards are alternatingly arranged.

14. The electrical connector as claimed in claim 13, wherein each row of the terminals comprises plural differential pairs of signal terminals and plural pairs of grounding terminals, the pairs of the signal and the grounding terminals being alternatingly arranged.

15. The electrical connector as claimed in claim 14, wherein each terminal comprises a contacting beam electrically connecting with a corresponding conductive trace, a tail portion for electrical connection to a printed circuit board and an intermediate portion interconnecting the contacting beam and the tail portion, the contacting beams of the differential pair of the signal terminals extending upwardly from the intermediate portions adjacent innermost edges.

16. The electrical connector as claimed in claim 15, wherein each terminal comprises a press-fit tail opposite to the contacting beam, the press-fit tail extending beyond a bottom of the housing for electrical connection to a printed circuit board.

17. The electrical connector as claimed in claim 1, wherein the circuit boards have mounting portions received in corresponding slots of the housing, and the terminals are soldered to the mounting portions.

18. An electrical connector comprising:

a unitary insulative housing defining a plurality of parallel slots therein;

plural rows of terminals disposed in the slots, respectively;

a plurality of parallel arranged circuit boards received in the corresponding slots, respectively, each of said circuit boards including conductive traces located in the corresponding slot and mechanically and electrically engaged with the corresponding terminals, respectively; and a metallic shell enclosing both said housing and said printed circuit boards, and defining a plurality of parallel lances on a top wall thereof; wherein upper portions of said printed circuit boards are respectively retained by the lances, and lower portions of said printed circuit boards are respectively retained in the slots.

19. The connector as claimed in claim 18, wherein all said housing is vertically spaced from the top wall and only retains the lower portions of the printed circuit board.

20. The connector as claimed in claim 19, wherein said terminals are soldered to the lower portions of the corresponding printed circuit boards.

* * * * *